US007830343B2

(12) United States Patent
Chiou

(10) Patent No.: US 7,830,343 B2
(45) Date of Patent: Nov. 9, 2010

(54) ORGANIC LIGHT-EMITTING DIODE (OLED) DISPLAY AND DATA DRIVER OUTPUT STAGE THEREOF

(75) Inventor: Yu-Wen Chiou, Sinshih Township, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 766 days.

(21) Appl. No.: 11/648,545

(22) Filed: Jan. 3, 2007

(65) Prior Publication Data

US 2007/0152924 A1 Jul. 5, 2007

(30) Foreign Application Priority Data

Jan. 3, 2006 (TW) ..... 95100237 A

(51) Int. Cl.
*G09G 3/32* (2006.01)

(52) U.S. Cl. ..... 345/82; 345/76; 345/98; 345/100; 345/211; 345/690

(58) Field of Classification Search ..... 345/76, 345/82, 98, 100, 211, 690
See application file for complete search history.

(56) References Cited

U.S. PATENT DOCUMENTS

2004/0150595 A1* 8/2004 Kasai ..... 345/82
2005/0012697 A1* 1/2005 Suzuki ..... 345/76
2005/0225517 A1* 10/2005 Sun ..... 345/76

* cited by examiner

*Primary Examiner*—Richard Hjerpe
*Assistant Examiner*—Saifeldin Elnafia
(74) *Attorney, Agent, or Firm*—Rabin & Berdo, P.C.

(57) ABSTRACT

An output stage circuit of a data driver for an display is provided. The circuit includes a current mirror having a first transistor and a current source on a reference current path, having a second transistor on an output current path, wherein the reference and output current paths are commonly coupled to a power line, a capacitor having a first end coupled to the power line and a second end coupled to a gate of the second transistor, a first switch cutting off the output current path during a first period, and a second switch coupling the second end of the capacitor to the current source during the first period.

8 Claims, 5 Drawing Sheets

200

200

ORGANIC LIGHT-EMITTING DIODE (OLED) DISPLAY AND DATA DRIVER OUTPUT STAGE THEREOF

This application claims the benefit of Taiwan application Serial No. 95100237, filed Jan. 3, 2006, the subject matter of which is incorporated herein by reference.

BACKGROUND OF THE INVENTION

1. Field of the Invention

The invention relates to an OLED display and, and more particularly to an output stage circuit of a data driver for the OLED display.

2. Description of the Related Art

FIG. 1 shows a conventional output stage circuit 100 of a data driver for the OLED display. The circuit 100 is substantially a current mirror which provides data currents I1~In by mirroring a reference current I from the circuit 110 onto output channels of the circuits 120. Due to a large number of the output channels, the supply voltage Vdd is transmitted through a relatively long power line 130 having parasitic resistors R. The long power line 130 results in drops of the supply voltages actually received by the circuits 120 and causes non-uniformity of the data currents I1~In.

A conventional approach to the previously described issue is to enlarge the width of the power line 130. However, a wide power line consumes a large circuit area, which increases the cost.

SUMMARY OF THE INVENTION

The invention is directed to an OLED display and an output stage circuit of a data driver for the OLED display, wherein the voltage drop issue is eliminated without a wide power line.

According to a first aspect of the present invention, an output stage circuit of a data driver for a display is provided. The circuit includes a current mirror having a first transistor and a current source on a reference current path, having a second transistor on an output current path, wherein the reference and output current paths are commonly coupled to a power line, a capacitor having a first end coupled to the power line and a second end coupled to a gate of the second transistor, a first switch cutting off the output current path during a first period, and a second switch coupling the second end of the capacitor to the current source during the first period.

The invention will become apparent from the following detailed description of the preferred but non-limiting embodiments. The following description is made with reference to the accompanying drawings.

DETAILED DESCRIPTION OF THE INVENTION

Figure 1:
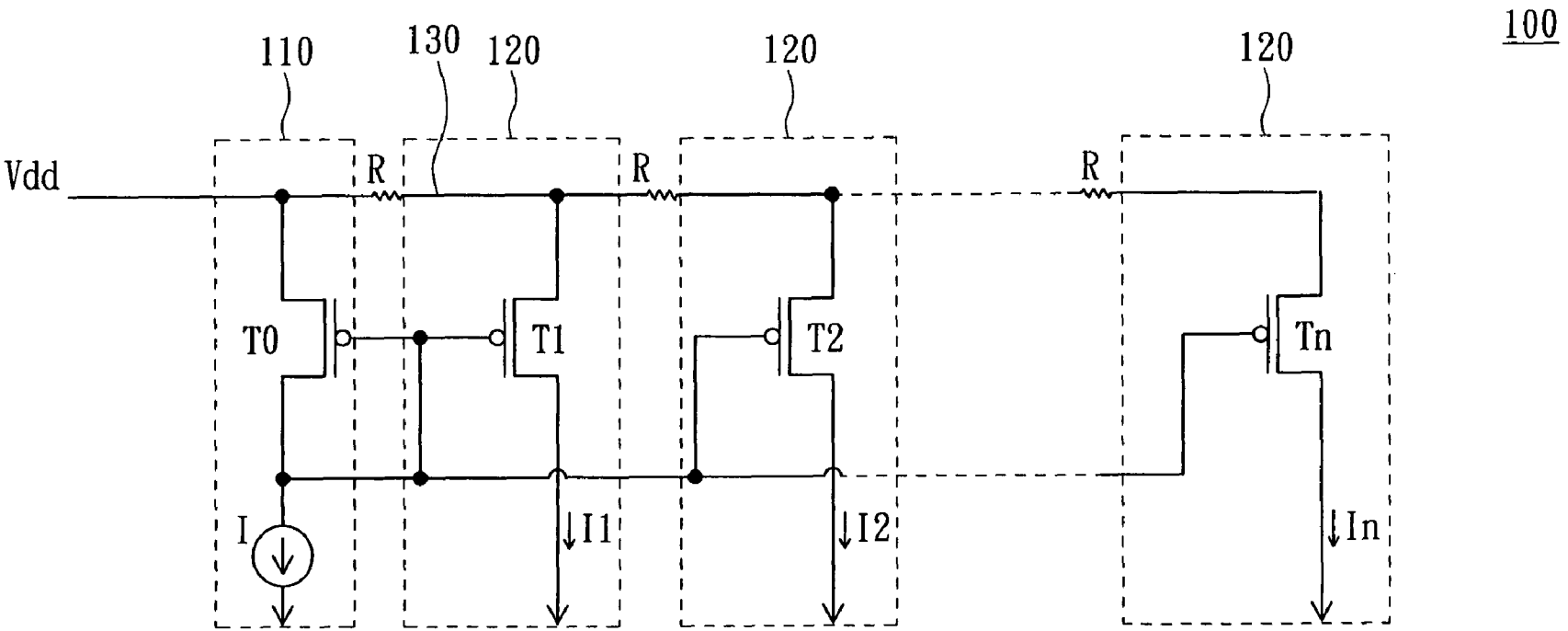
FIG. 1(PRIOR ART)
FIG. 1 shows a conventional output stage circuit of a data driver for an OLED display.
Figure 2A:
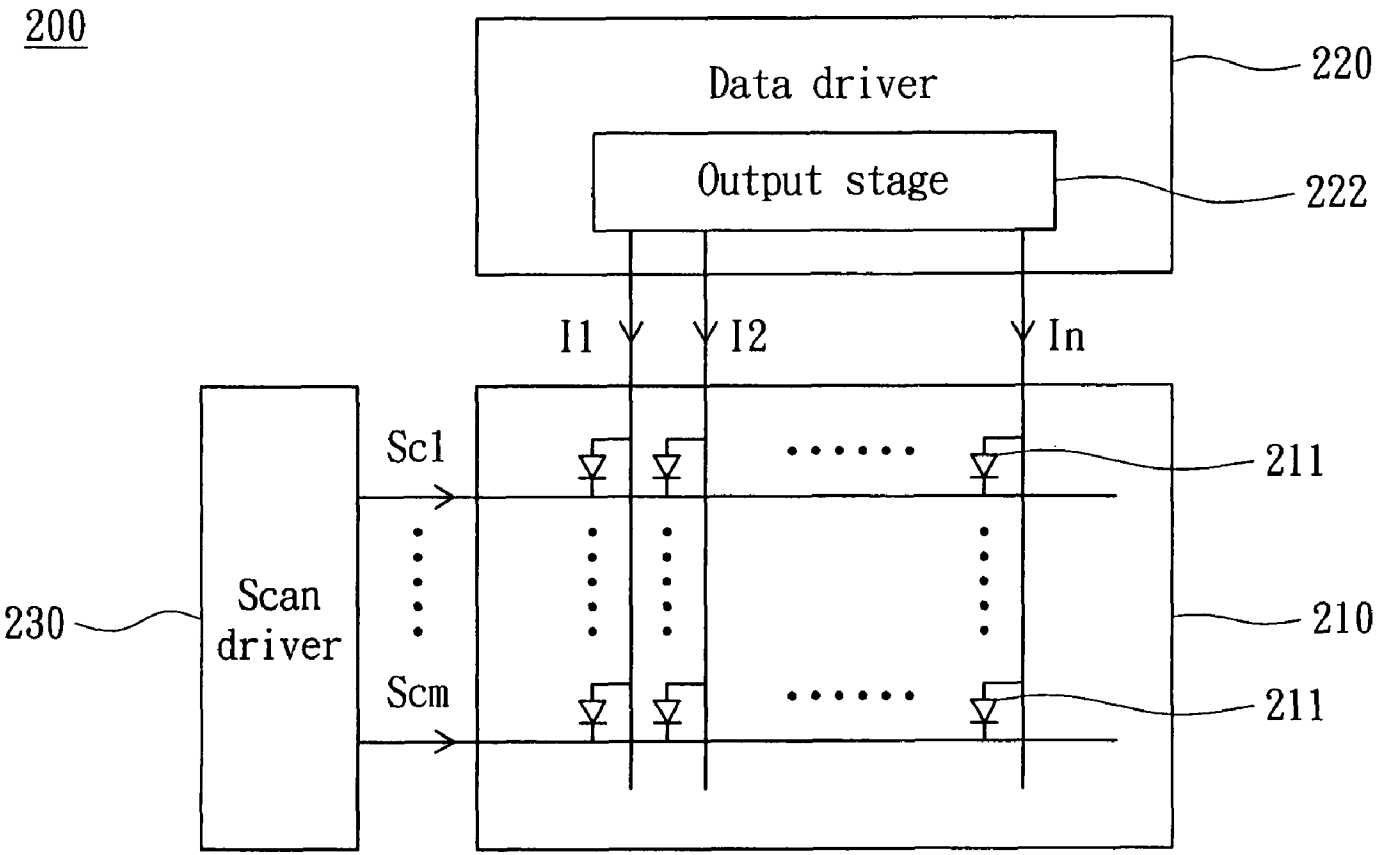
FIG. 2A shows an OLED display circuit according to a preferred embodiment of the invention.

FIG. 2A shows an OLED display 200 according to a preferred embodiment of the invention. The OLED display 200 may be a passive matrix OLED (hereinafter referred to as PMOLED) display or a current mode active matrix OLED (hereinafter referred to as AMOLED) display, and includes an OLED display panel 210, a data driver 220 and a scan driver 230. The panel 210 includes m×n pixels 211, wherein m and n are positive integers. The data driver 220 outputs n data currents I1 to In to the n columns of the pixels 211 through an output stage circuit 222. The m rows of the pixels 211 are sequentially enabled by the scan signals Sc1 to Scm to be driven by the data currents so that frames of a video clip are displayed.

Figure 2B:
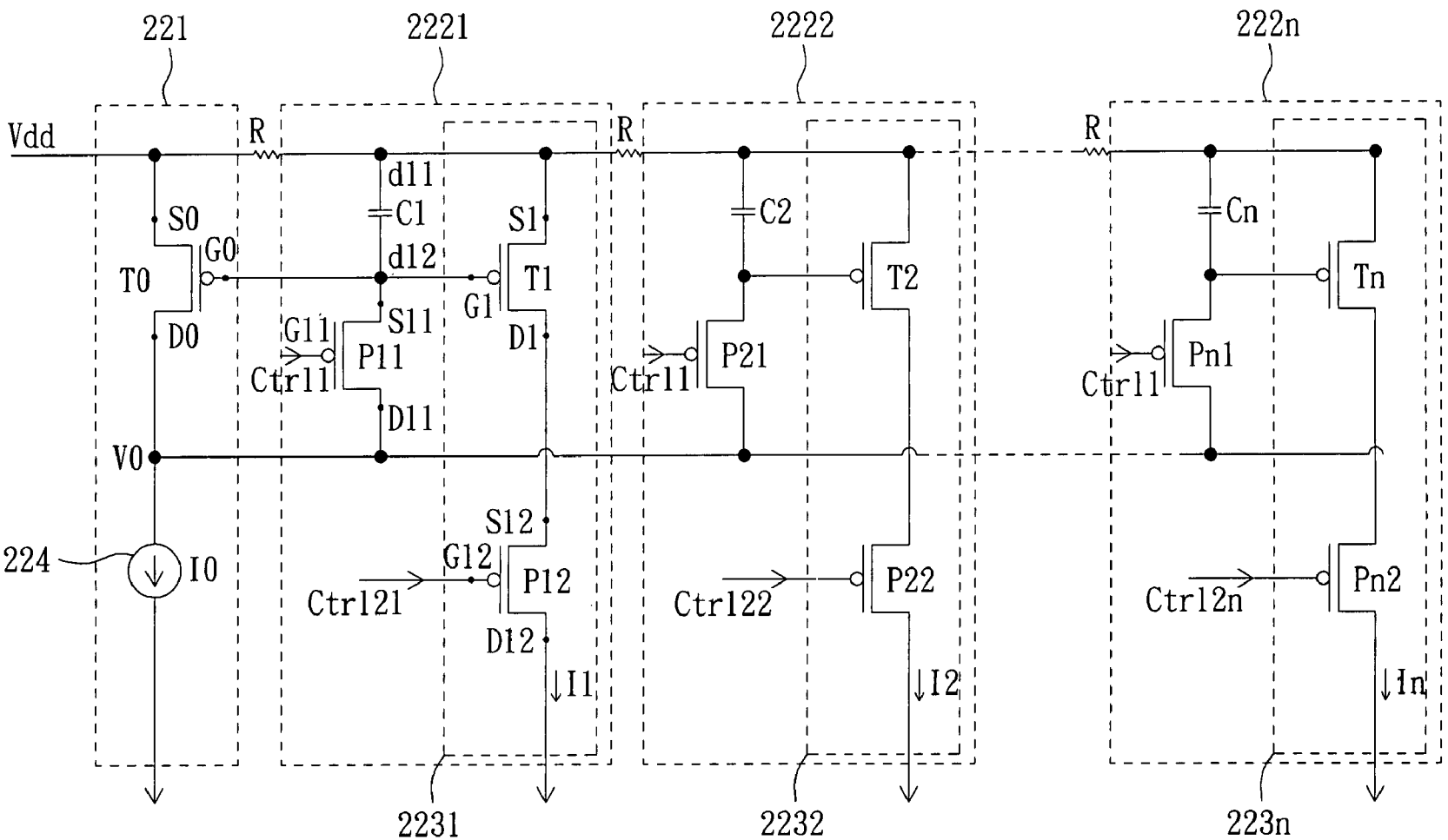
FIG. 2B shows an output stage circuit of the data driver 220 in FIG. 2A.

FIG. 2B shows the output stage circuit 222 of FIG. 2A. The output stage circuit 222 is substantially a modified current mirror which provides data currents I1~In by mirroring a reference current I0 from the circuit 221 onto output channels of the circuits 2221 to 222*n*. The supply voltage Vdd is transmitted through a power line having parasitic resistors R. the circuit 221 includes a current source 224 and a P-type MOS (PMOS) transistor T0 on a reference current path. The current source 224 is coupled to the drain D0 of the transistor T0 and provides the constant current I0, and a source S0 of the transistor T0 is coupled to receive the supply voltage Vdd.

The circuits 2221 to 222*n* have a similar circuit structure. For clarity, the following explanation is only made to the circuit 2221.

The circuit 2221 includes PMOS transistors T1 and P12 on the output current path wherein the data current I1 flows, a capacitor C1, and a PMOS transistor P11. The capacitor C1 has a first terminal d11 coupled to receive the supply voltage Vdd, and a second terminal d12 coupled to a gate G0 of the transistor T0. The transistor P11 substantially acts as a switch, and has a source S11 coupled to the second terminal d12 of the capacitor C1, a drain D11 coupled to the current source 224 of the current source circuit 221, and a gate G11 receiving a first control signal Ctrl1. The transistor T1 has a source S1 coupled to receive the supply voltage Vdd, a gate G1 coupled to the second terminal d12 of the capacitor C1, and a drain D1 coupled to a source S12 of the transistor P12. The transistor P12 also acts as a switch, and has a gate G12 receiving a second control signal Ctrl21, and a drain D12 outputting the data current I1. It is noted that the transistors P11~Pn1 receive the same control signal Ctrl1 while the transistors P12~Pn2 respectively receive control signals Ctrl21~Ctrl2*n*.

Figure 3:
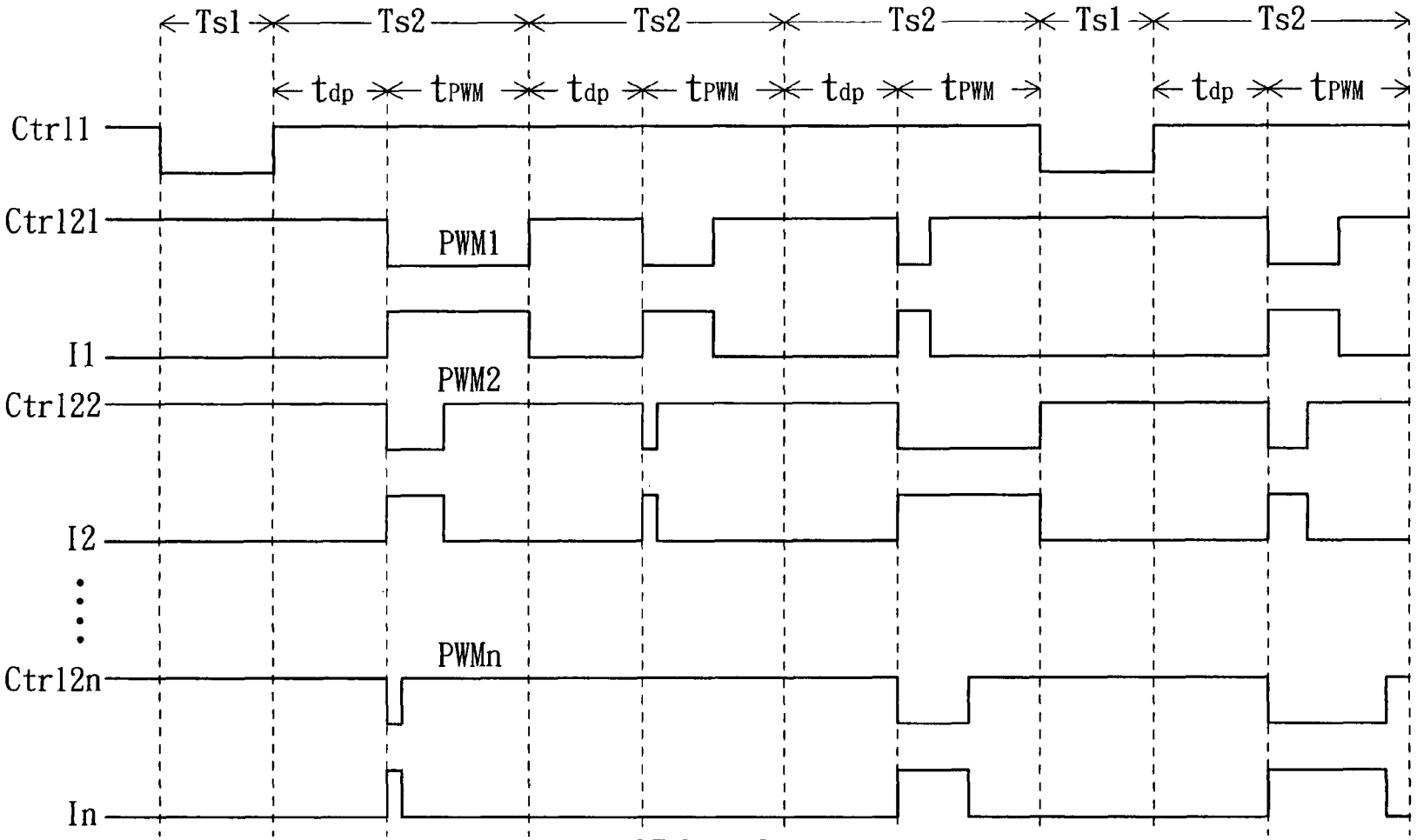
FIG. 3 shows the signals used in the output stage circuit in FIG. 2B.

FIG. 3 shows the signals used in the output stage circuit 222 of FIG. 2B. In a period Ts1 wherein the data driver refreshes data for a next row ofpixels, the first control signal Ctrl1 has a low logic level L and the secondcontrol signals Ctrl21~Ctrl2*n* have a high logic level so that the transistors P11 to Pn1 are turned on and the transistors P12 to Pn2 are turned off. Sincethe output current paths are cut off by the control signals Ctrl21~Ctrl2*n*, thereis no data current drawn from the power line and therefore no voltage drop occurs on the power line. Thus, when the capacitors C1~Cn are fully-charged at the end of the period Ts1, the voltage difference on each of themis (Vdd−V0), wherein V0 is the voltage on the source of the transistor T0.

In a period Ts2 wherein the data driver outputs data currents for redpixels, the first control signal Ctrl1 turns off the transistors P11 to Pn1. Theperiod Ts2 is divided into a sub-period Tdp wherein the pixels arepre-discharged and pre-charged, and a sub-period Tpwm wherein the pixels are driven by the data current from the data driver. In the sub-period Tdp,the control signals Ctrl21 to Ctrl2*n* turns off the transistors P12-Pn2. In thesub-period Tpwm, the control signals Ctrl21~Ctrl2*n* acts as PWM signals having pulse widths corresponding to values of the pixels to be driven. It isnoted that the capacitors C1 to Cn retain the drain-gate voltages of thetransistors T1~Tn at (Vdd−V0) during the sub-period Tpwm. Thus, the voltage drops on the power line has no impact on the magnitude of the data currents, which ensures their uniformity.

Figure 4:
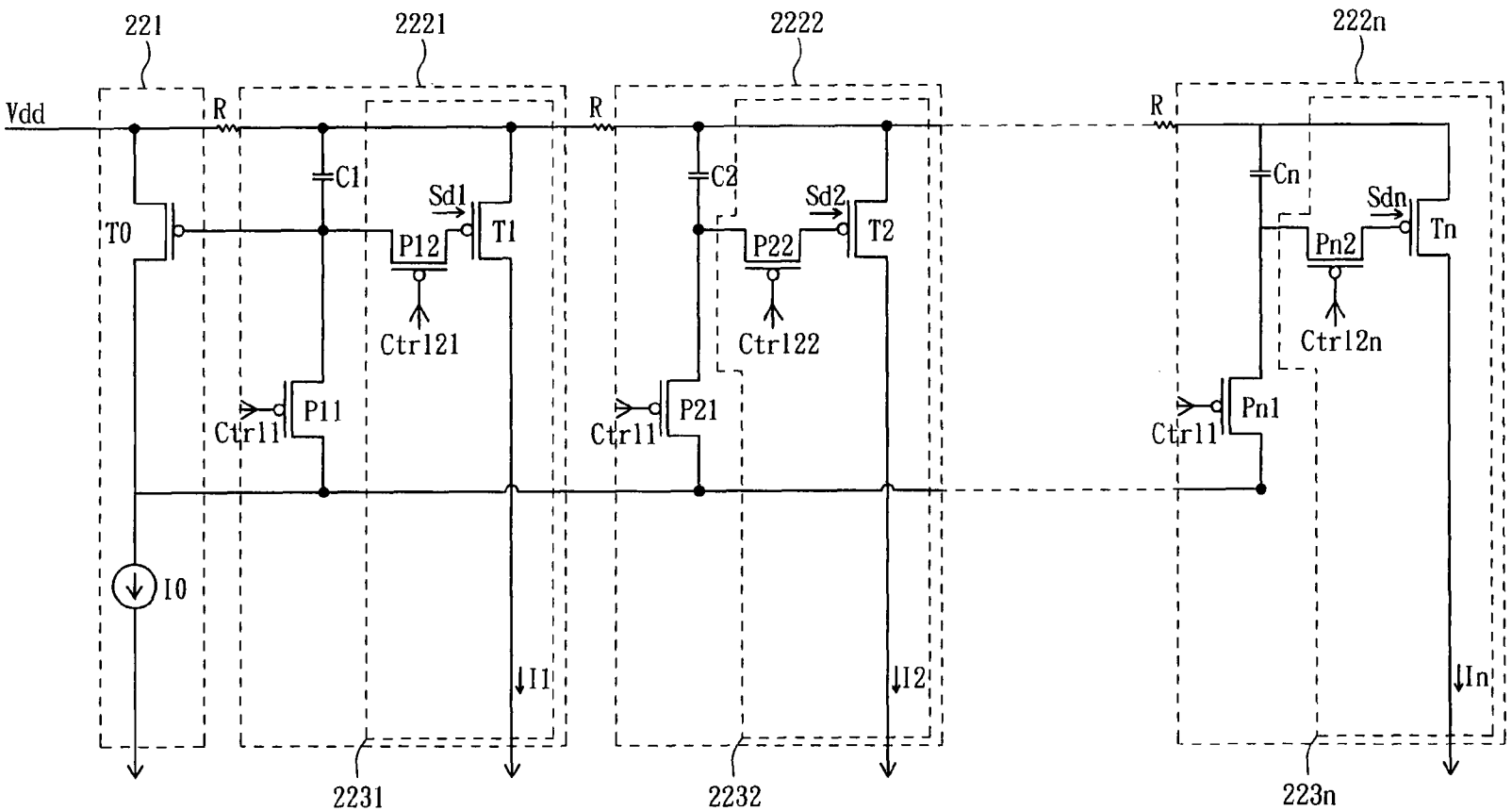
FIG. 4 shows an output stage circuit of a data driver for an OLED display according to another embodiment of the invention.

FIG. 4 shows an output stage circuit 200 of a data driver for an OLED display according to another embodiment of the invention. The circuit 200 is largely the same as the circuit 220 of FIG. 2B except that the transistors P12~Pn2 are not disposed on the output current paths. Each of the transistors P12~Pn2 has a source/drain coupled to the gate of the transistor T1, T2, . . . , or Tn, and the other source/drain coupled to the capacitor C1, C2, . . . or Cn. The timing of the signals used in the circuit 200 is the same as that used in the circuit 220 of FIG. 2B. Thus, the capacitors C1~Cn retain the drain-gate voltages of the transistors T1 to Tn at (Vdd−V0) during the sub-period Tpwm. The voltage drops on the power line is compensated and the same drain-gate voltages of the transistors T1 to Tn ensures uniformity of the data currents I1 to In.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An output stage circuit of a data driver for a display, comprising:

a current mirror having a first transistor and a current source on a reference current path, having a second transistor and a third transistor respectively on a first output current path and a second output current path, wherein the reference and output current paths are commonly coupled to a power line;

a first capacitor having a first end coupled to the power line and a second end coupled to a gate of the second transistor;

a second capacitor having a first end coupled to the power line and a second end coupled to a gate of the third transistor;

a first switch cutting off the first output current path during a first period;

a second switch coupling the second end of the first capacitor to the current source during the first period; and a third switch coupling the second end of the second capacitor to the current source during the first period.

2. The output stage circuit according to claim 1, wherein the data driver refreshes data for a pixel during the first period.

3. The output stage circuit according to claim 2, wherein the data driver precharges or pre-discharges the pixel during the second period, and the first switch cuts off the output current path, and the second switch and the third switch decouple the second end of the first capacitor and the second end of the second capacitor respectively from the current source, during the second period.

4. The output stage circuit according to claim 3, wherein during the third period, the current mirror generate data currents on the output current paths mirrored from a reference current generated by the current source, and the second switch and the third switch decouple the second end of the first capacitor and the second end of the second capacitor from the current source.

5. The output stage circuit according to claim 4, wherein the first switch is controlled by a PWM signal having a pulse width corresponding to a value of the pixel during the third period.

6. The output stage circuit according to claim 1, wherein the first switch is coupled between a pixel and the second transistor.

7. The output stage circuit according to claim 1, wherein the first switch and the second switch are MOS transistors.

8. An output stage circuit of a data driver for a display, comprising:

a current mirror having a first transistor and a current source on a reference current path, and having a second transistor on an output current path, wherein the reference and output current paths are commonly coupled to a power line;

a capacitor having a first end coupled to the power line and a second end coupled to a gate of the second transistor;

a first switch cutting off the output current path during a first period, wherein the first switch is coupled between the second end of the capacitor and a gate of the second transistor; and a second switch coupling the second end of the capacitor to the current source during the first period.

* * * * *